US010400787B2

(12) United States Patent
Bertoneri et al.

(10) Patent No.: US 10,400,787 B2
(45) Date of Patent: Sep. 3, 2019

(54) SEALING DEVICE FOR TURBOMACHINES

(71) Applicant: Nuovo Pignone Srl, Florence (IT)

(72) Inventors: Matteo Bertoneri, Florence (IT); Emanuele Rizzo, Florence (IT); Mirco Tavernari, Florence (IT)

(73) Assignee: Nuovo Pignone Srl, Florence (IT)

( * ) Notice: Subject to any disclaimer, the term of this patent is extended or adjusted under 35 U.S.C. 154(b) by 309 days.

(21) Appl. No.: 15/315,005

(22) PCT Filed: May 28, 2015

(86) PCT No.: PCT/EP2015/061901
§ 371 (c)(1),
(2) Date: Nov. 30, 2016

(87) PCT Pub. No.: WO2015/181326
PCT Pub. Date: Dec. 3, 2015

(65) Prior Publication Data

US 2017/0254341 A1 Sep. 7, 2017

(30) Foreign Application Priority Data

May 30, 2014 (IT) ..... FI2014A0133

(51) Int. Cl.
*F01D 11/02* (2006.01)
*F04D 29/42* (2006.01)
(Continued)

(52) U.S. Cl.
CPC ..... *F04D 29/4206* (2013.01); *F01D 11/02* (2013.01); *F04D 17/10* (2013.01);
(Continued)

(58) Field of Classification Search
CPC ..... F01D 11/02; F04D 29/102
(Continued)

(56) References Cited

U.S. PATENT DOCUMENTS 6,368,077 B1 4/2002 Meyerkord et al.
2004/0179935 A1* 9/2004 Maguire ..... F01D 25/183 415/111
(Continued)

FOREIGN PATENT DOCUMENTS

CN 1585862 A 2/2005
CN 201644244 U 11/2010
(Continued)

OTHER PUBLICATIONS

Unofficial English translation of Search Report and Written Opinion issued in connection with corresponding IT Appl. No. ITFI20140133 dated Sep. 11, 2014.
(Continued)

*Primary Examiner* — Patrick Hamo
(74) *Attorney, Agent, or Firm* — Baker Hughes Patent Organization

(57) ABSTRACT

A sealing device is described, for separating a first compartment from a second compartment in a turbomachine, a wet gas being processed in the first compartment. The sealing device comprises a rotary component and a stationary component. A sealing member is arranged between the rotary component and the stationary component. The device further comprises an annular wet-particles collector and an oil-jet element, mounted on the rotary component for rotation therewith. The oil-jet element is surrounded by the annular wet-particles collector, such that wet particles contacting the oil-jet element are projected by centrifugal force into the annular wet-particles collector.

20 Claims, 6 Drawing Sheets

(51) Int. Cl.

| | |
|---|---|
| ***F04D 17/10*** | (2006.01) |
| ***F04D 29/08*** | (2006.01) |
| ***F04D 29/28*** | (2006.01) |
| ***F04D 29/70*** | (2006.01) |

(52) U.S. Cl.
CPC ..... *F04D 29/083* (2013.01); *F04D 29/284* (2013.01); *F04D 29/706* (2013.01)

(58) Field of Classification Search
USPC ..... 415/111, 230
See application file for complete search history.

(56) References Cited

U.S. PATENT DOCUMENTS

| | | | | |
|---|---|---|---|---|
| 2009/0274548 | A1* | 11/2009 | Joco | F01D 11/02 415/112 |
| 2011/0047959 | A1* | 3/2011 | DiBenedetto | F02C 7/052 60/39.092 |
| 2012/0230812 | A1 | 9/2012 | Jonen et al. | |
| 2013/0305684 | A1 | 11/2013 | Mastro | |
| 2015/0040566 | A1* | 2/2015 | Danescu | F01D 11/001 60/722 |
| 2015/0086343 | A1* | 3/2015 | Rizzo | F04D 29/102 415/173.5 |

FOREIGN PATENT DOCUMENTS

| | | | | |
|---|---|---|---|---|
| CN | 201875138 | U | 6/2011 | |
| EP | 2006511 | A2 | 12/2008 | |
| EP | 2299092 | A2 | 3/2011 | |
| RU | 2 036 312 | C1 | 5/1995 | |
| WO | 2013/162703 | A1 | 10/2013 | |
| WO | 2013160469 | A1 | 10/2013 | |
| WO | WO-2013160469 | A1 * | 10/2013 | F04D 29/102 |

OTHER PUBLICATIONS

International Search Report & Written Opinion issued in connection with corresponding Application No. PCT/EP2015/061901 dated Aug. 25, 2015.

First Office Action and Search issued in connection with corresponding CN Application No. 201580029023.8 dated Oct. 11, 2017.

Office action and search report issued in connection with corresponding RU Application No. 2016144915 dated Nov. 15, 2018.

* cited by examiner

SEALING DEVICE FOR TURBOMACHINES

BACKGROUND

The present disclosure refers to turbomachines. More specifically, the disclosure relates to improvements concerning sealing devices suitable for separating adjacent compartments in a turbomachine, such as a turbomachine which processes a wet gas, i.e. a gaseous flow containing liquid particles and/or solid particles.

In many industries, specifically but not exclusively in oil and gas extraction and processing industry, turbomachines are used, which process a gas that can contain solid or liquid particles entrained in the main gaseous flow processed through the turbomachine. Subsea compressors are typical examples of turbomachines which process a wet gas, as gaseous hydrocarbons extracted from a gas field often contain heavier hydrocarbons in the form of liquid droplets and/or solid matters dragged by the gas flowing through the turbomachine.

Turbomachines contain elements which are particularly sensitive to solid and/or liquid particles. Typical components which must be protected against the penetration of solid and/or liquid matter in a turbomachine, such as a centrifugal compressor, include, but are not limited to, active magnetic bearings, oil bearings, electric motors and the like. Typically, such components can be integrated in a turbomachine casing, e.g. in a compartment, which is separated by a compartment housing the compressor impellers and wherein wet gas is processed.

Sealing arrangements and devices are usually provided to separate a first compartment containing the compressor from adjacent compartments containing contaminant-sensitive components, such as bearing and electric motors. In some known embodiments buffer seals are used for isolating a compartment containing one or more contaminant-sensitive components from a compartment containing the compressor, and more specifically the compressor impellers through which contaminated gas, i.e. gas containing contaminants in the form of liquid and/or solid particles, is processed.

Dry gas is delivered to the buffer seals to generate a gas barrier between the two compartments, aimed at preventing the ingress of contaminants from the compressor compartment, or the compartment housing the compressor impellers, into the protected compartments containing the contaminant-sensitive component(s) of the compressor.

Dry gas is sometimes provided from an external source of clean gas. Particularly in off-shore installations providing a source of clean dry gas is a costly exercise, since no such source is available near the off-shore installation. Systems have therefore been developed, which use the same gas processed by the compressor to provide dry gas to the buffer seals. Gas is extracted from the compressor, cleaned and conditioned in a dry gas skid or the like and subsequently delivered to the buffer seals.

In spite of the efforts devoted to the improvement of buffer seals or dry gas seals, there is still a constant need for further improving the sealing efficiency of such devices.

BRIEF DESCRIPTION

According to some embodiments, for effectively protecting a contaminant-sensitive component from contaminants contained in a gaseous flow processed in a first compartment of a turbomachine, such as but not limited to a wet-gas compressor, a sealing device is provide between the first compartment and a second compartment, wherein at least one contaminant-sensitive component is arranged. The sealing device comprises a rotary component and a stationary component and is comprised of a first end facing the first compartment and a second end facing the second compartment. The rotary component can be a portion of a rotating shaft of a turbomachine, or a component mounted for co-rotation on the shaft. The sealing device further comprises at least a first sealing member arranged between the rotary component and the stationary component in a position intermediate the first compartment and the second compartment. In some embodiments, a dry-gas delivery port can also be arranged for delivering dry gas between the rotary component and the stationary component. An annular wet-particles collector is further provided between the first compartment and the second compartment. The annular wet-particles collector is stationary, i.e. it is fixed in the stationary component of the sealing device. An oil-jet element, such as an oil-jet ring, can be mounted on the rotary component for rotation therewith. In an embodiment, the oil-jet ring and the annular wet-particles collector are arranged at approximately the same axial position along a rotation axis, such that the annular wet-particles collector surrounds the oil-jet ring. In this way liquid and/or solid particles contacting the oil-jet ring are projected thereby centrifugally into the annular wet-particles collector when the oil-jet ring rotates integrally with the rotating shaft around the rotation axis. The first sealing member is arranged between the first compartment and the oil-jet ring.

In exemplary embodiments, the dry-gas delivery port is arranged between the oil-jet ring and the second compartment.

Dry gas as used in the context of the present description and appended claims shall be understood as a gas containing a lesser amount of liquid and/or solid particles than the gas processed by the turbomachine.

The term annular wet-particles collector shall be understood as a collector, which collects non-gaseous particles, i.e. both solid particles as well as liquid particles or droplets which might be contained in gas leaking from the first compartment towards the second compartment.

In exemplary embodiments, the first sealing member can comprise a plurality of circumferential teeth forming a labyrinth seal adjacent the oil-jet ring. The oil-jet ring can be one of the circumferential teeth of the labyrinth seal. In some embodiments, however, the oil-jet ring has a diameter larger than the diameter of the teeth forming the labyrinth seal, for a more efficient contaminants-collecting effect. An oil-jet ring with a larger diameter more efficiently collects liquid droplets and/or solid particles leaking through the labyrinth seal, since a larger cross sectional area surrounding the rotational shaft is covered by the oil-jet ring.

In particularly efficient embodiments, the device can further comprise a second sealing member between the rotary component and the stationary component, arranged between the oil-jet ring and the second compartment. The dry gas delivery port(s) can be located between the second compartment and the second sealing member. The second sealing member can have a pumping effect upon the dry gas flow, pushing the dry gas flow towards the first sealing member and the first compartment.

According to a further aspect, the disclosure relates to a wet gas compressor comprising: a casing; at least one impeller arranged for rotation in a first compartment in the casing; at least a second compartment housing a contaminant-sensitive component; a sealing device as described above. As used herein the term "contaminant-sensitive component" shall be understood as any component, which can be damaged by contaminants, e.g. liquid and/or solid particles contained in the gas processed by a turbomachine, in which the sealing device is arranged.

According to a further aspect, the disclosure relates to a method for separating a first compartment from a second compartment in a turbomachine, wherein a process gas containing contaminants is processed in the first compartment and a contaminant-sensitive component is housed in the second compartment. The method comprises the following steps: providing a stationary component and a rotary component between the first compartment and the second compartment; arranging at least a first sealing member between the first compartment and the second compartment; arranging an annular wet-particles collector between the first compartment and the second compartment, the stationary annular wet-particles collector surrounding the rotary component; arranging an oil-jet element, for instance an oil-jet ring, on the rotary component for rotation therewith, between the first sealing member and the second compartment, the oil-jet ring being surrounded by the annular wet-particles collector; rotating the rotary component and the oil-jet ring; and collecting contaminants leaking from the first compartment towards the second compartment by means of the oil-jet ring and projecting by centrifugal force the contaminants by means of the oil-jet ring into the stationary annular wet-particles collector.

According to some embodiments, the method of the present disclosure can further comprise the steps of arranging a dry-gas delivery port between the second compartment and the first sealing member, and delivering dry gas through the dry-gas delivery port towards the first sealing member.

According to a further aspect, the disclosure relates to a sealing device for separating a first compartment from a second compartment in a turbomachine, such as a wet-gas compressor, a wet gas being processed in the first compartment; the sealing device comprising: a rotary component; a stationary component; at least a first sealing member between the rotary component and the stationary component; a second sealing member between the rotary component and the stationary component, the first sealing member being arranged between the second sealing member and the first compartment; and a dry-gas delivery port, arranged for delivering dry gas between the rotary component and the stationary component; wherein at least one of the first sealing member and the second sealing member has at least one helical projection arranged on the rotary component for rotation therewith.

A method for separating a first compartment from a second compartment in a wet-gas compressor or other turbomachine is further disclosed, wherein a process gas containing contaminants is processed in the first compartment and a contaminant-sensitive component is housed in the second compartment; the method comprising the following steps: providing a stationary component and a rotary component between the first compartment and the second compartment; arranging a first sealing member between the first compartment and the second compartment; arranging a dry-gas delivery port between the second compartment and the first sealing member; arranging a second sealing member between the dry-gas delivery port and the first sealing member; rotating the rotary component and the oil-jet ring; and delivering dry gas through the dry-gas delivery port towards the first sealing member.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In the following description, reference is specifically made to a wet-gas turbo compressor, for instance a centrifugal turbo compressor. The subject matter disclosed herein, however, can be usefully applied in other turbomachines, where similar needs for separating a first compartment from a second compartment arise.

Figure 1:
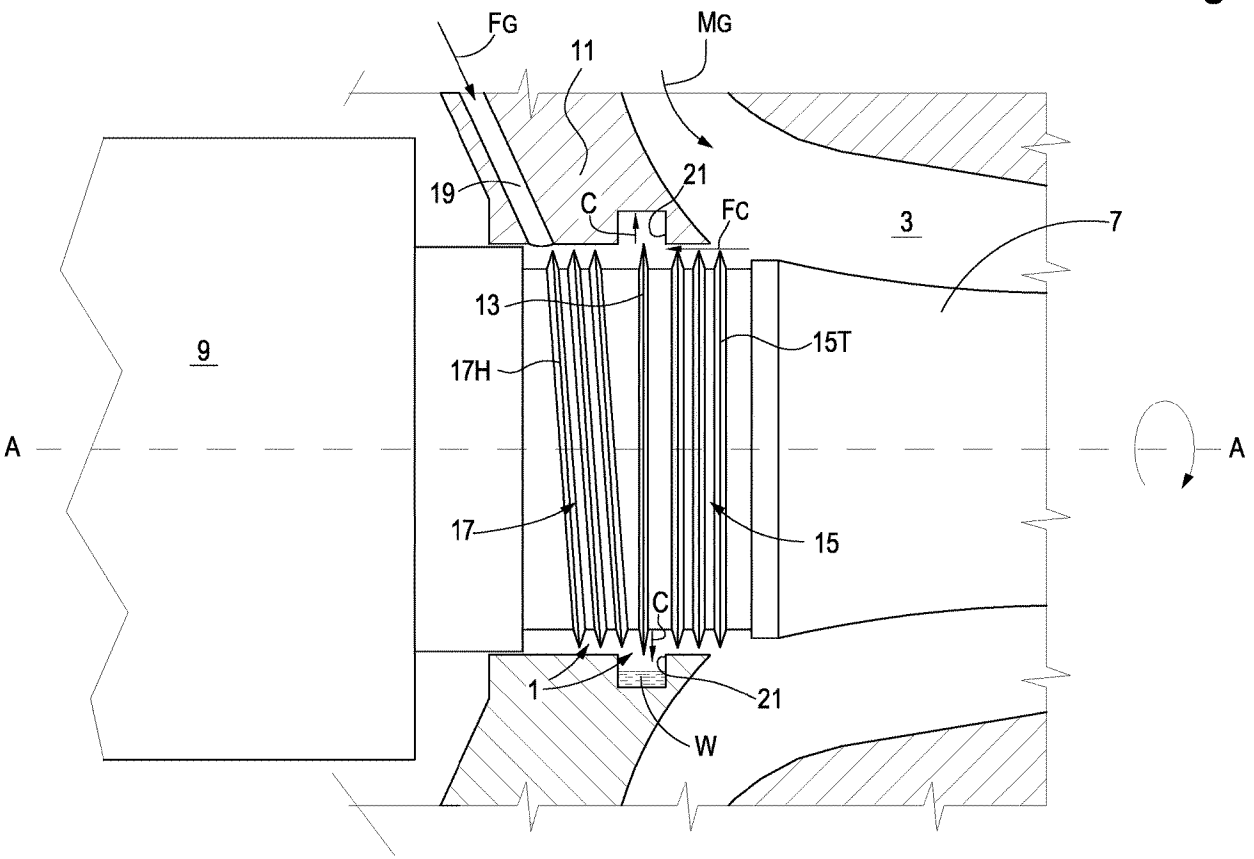
FIGS. 1, 2, 3, 4, and 5 are schematics of embodiments of sealing devices according to the present disclosure.

FIG. 1 schematically illustrates a first embodiment of a sealing device according to the present disclosure. The sealing device is designated 1 as a whole and separates a first compartment 3 from a second compartment 5. The first and second compartments 3, 5 can be arranged in a turbomachine, for example a centrifugal compressor, such as a wet gas centrifugal compressor. More details on an exemplary turbomachine employing sealing devices as disclosed herein will be given herein below, reference being made to FIG. 6.

The first compartment 3 can be for example the compartment wherein one or more compressor impellers are mounted for rotation about a rotation axis A-A. Compartment 5 can be provided for housing a contaminant-sensitive component, i.e. a component which can be damaged by liquid and/or solid contaminants contained in the gaseous flow processed in compartment 3. The contaminant-sensitive component can be a bearing for supporting a rotating shaft 7 of the turbomachine. In some embodiments the bearing can be an active magnetic bearing. In some embodiments, the contaminant-sensitive component can comprise an electric motor, or a combination of one or more elements, such as motors and bearings.

In the schematic of FIG. 1, reference number 9 designates a generic contaminant-sensitive component of the turbomachine, wherein the sealing device 1 is mounted.

Reference number 11 schematically designates a stationary component of the turbomachine, for example a compressor diaphragm or a stationary partition wall, separating the compartments 3 and 5 from one another.

In some embodiments the sealing device 1 comprises an oil-jet ring 13, which is mounted on shaft 7 for rotation therewith. As used herein the term "oil-jet ring" shall be understood as any broadly disc-shaped or a ring-shaped component suitable for co-rotation with the shaft 7 and capable of intercepting liquid and/or solid particles migrating from the compartment 3 along the shaft 7 towards the compartment 5, according to arrow FC. The contaminants particles impinge against the oil-jet ring 13 and are projected radially outwardly by centrifugal force generated by the rotation of the oil-jet ring 13 around the rotation axis A-A.

According to some embodiments, the oil-jet ring can be shaped such as to facilitate detachment of solid and/or liquid contaminants therefrom by centrifugal force. As shown in the exemplary embodiments illustrated in the drawings, the oil-jet ring 13 has a bi-conical shape, with a sharp annular edge. In other embodiments, a different shape can be foreseen. In an embodiment, the thickness of the oil-jet ring decreases in a radial outward direction, such that the outer periphery thereof is thinner than the remaining part of the ring.

In order to limit the flow of gaseous, liquid or solid matters from the compartment 3 towards and through the sealing device 1, according to some embodiments a first sealing member 15 is arranged between the rotary shaft 7 and the stationary component 11. In some exemplary embodiments the first sealing member 15 can be arranged between the oil-jet ring and the second compartment 5. In other embodiments, the first sealing member is positioned between the first compartment 3 and the oil-jet ring 13.

In the exemplary embodiment of FIG. 1 the first sealing member 15 is located between the first compartment 3 and the oil-jet ring. The first sealing member 15 can be comprised of one or more annular teeth 15T forming a labyrinth seal. Each tooth 15T is in actual fact formed by a ring which extends from the rotary shaft 7 towards the stationary component 11 and rotates with the rotary shaft 7 around rotation axis A-A.

According to some embodiments, as shown by way of example in FIG. 1, a second sealing member 17 can be arranged on the rotating shaft 7 between the oil-jet ring 13 and the second compartment 5. As shown in FIG. 1, in exemplary embodiments the second sealing member 17 is comprised of one or more helical projections 17H mounted on the rotating shaft 7 and projecting towards the stationary component 11. The helical projections 17H form a sort of single-threaded, i.e. a single-start screw, or a multi-threaded, i.e. a multi-start screw.

According to some embodiments, the sealing device 11 further comprises at least one dry gas delivery port 19, which is configured and arranged to deliver a flow of buffer gas or dry gas FG in or around the sealing device 1. The dry gas flow FG can be provided by a dry gas treatment skid (not shown), which cleans and processes gas extracted from the main flow of gas processed by the turbomachine, wherein the sealing device 1 is mounted. According to other embodiments, the dry gas or buffer gas flow FG can be provided by a separated source of dry gas, e.g. by a so-called umbilical system, connecting the turbomachine with a distant source of clean gas. In some embodiments, a plurality of dry gas delivery ports 19 can be provided, e.g. arranged circumferentially around the rotation axis A-A, such as with a constant angular pitch.

According to the embodiment of FIG. 1, the sealing device 1 further comprises an annular wet-particles collector 21. The annular wet-particles collector 21 can develop annularly around the rotating shaft 7 and can be suitably positioned at approximately the same axial position as the oil-jet ring 13. In this manner, liquid and/or solid particles collected by the oil-jet ring 13 and projected thereby radially outwardly by centrifugal force are collected in the annular wet-particles collector and can accumulate in the lower part thereof, as shown at W in FIG. 1.

In this embodiment, the turbomachine wherein the sealing device 1 is mounted, is installed in horizontal position, i.e. with the rotation axis A-A substantially horizontal, such that the liquid and/or solid particles accumulate under the rotation axis A-A of rotating shaft 7. In other embodiments, the turbomachine can be installed with the rotation axis A-A in a substantially vertical position. In that case, the annular wet-particles collector 21 can be shaped so that the liquid and/or solid particles accumulate in a radially outwardly located volume placed at the bottom of the annular wet-particles collector.

The operation of the sealing device 1 described so far is the following. During rotation of the turbomachine the shaft 7 rotates around rotation axis A-A. Impellers of the turbomachine (not shown) mounted on shaft 7 process a main gas flow MG boosting the pressure thereof from a lower suction pressure to a higher delivery pressure. The main gas flow can contain liquid and/or solid contaminants. Due to the pressure difference between the first compartment 3 and the second compartment 5, gas can flow through the sealing device 1, in spite of the presence of the first sealing member 15. Such leakage represented by arrow FC can drag liquid and/or solid contaminants. The contaminant particles are collected by the oil-jet ring 13 that rotates integrally with the rotating shaft 7. Contaminants contacting the surface of the oil-jet ring 13 are projected radially outwardly according to arrow C into the annular wet-particles collector 21, preventing the ingress of such contaminants in the second compartment 5, wherein the contaminant-sensitive component 9 of the turbomachine is housed.

Buffer gas or dry seal gas FG is further injected through dry gas delivery port(s) 19 towards the sealing members 17 and 15. In the embodiment of FIG. 1 the helical projection 17H of the second sealing member 17 provide a pumping effect on the dry gas FG towards the first compartment 3. This effect further contributes to prevent or reduce a gas flow from compartment 3 towards compartment 5.

An efficient barrier effect against ingress of processed gas and relevant contaminants into the second compartment 5 is thus obtained.

Liquid and/or solid contaminant particles collected at W in the annular wet-particles collector 21 can be removed either during operation of the turbomachine, or while the latter is stopped.

Figure 2:
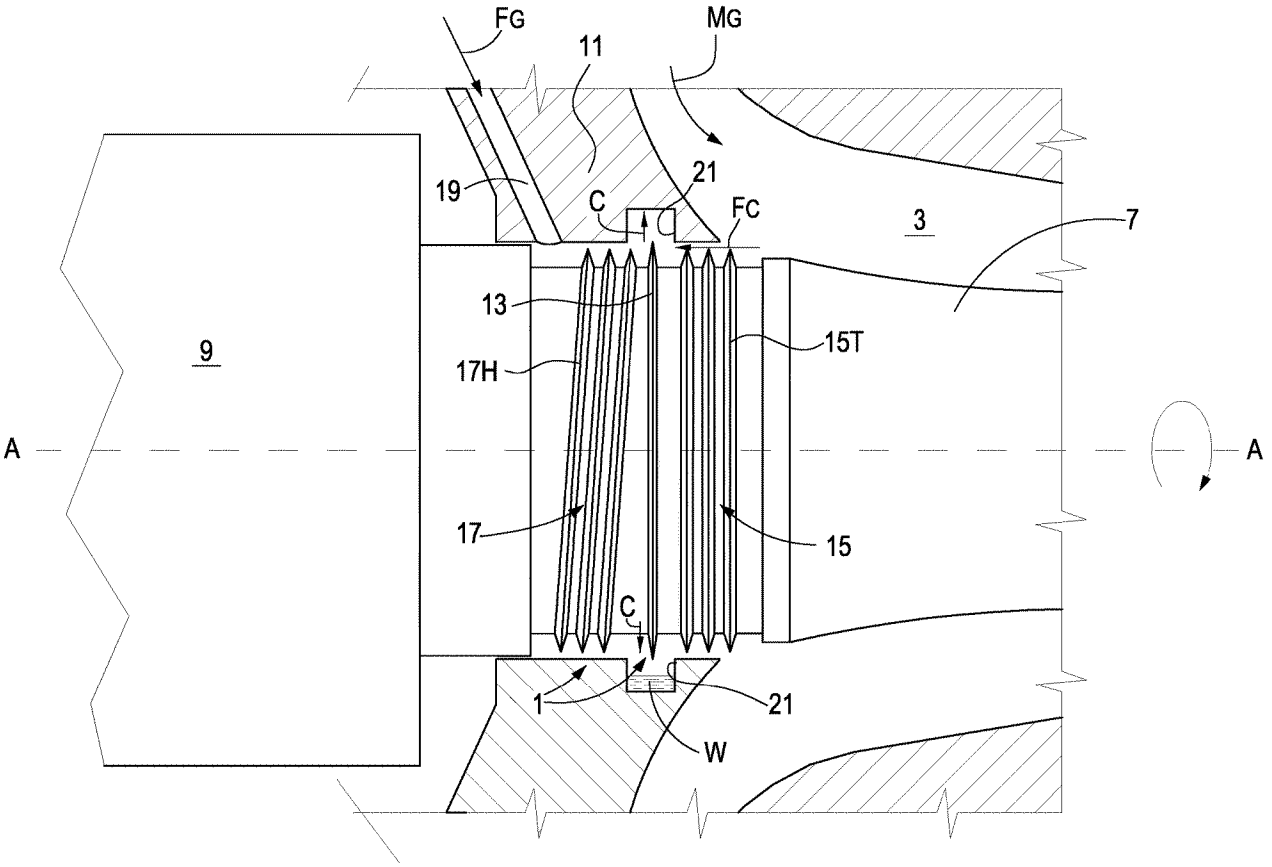

FIG. 2 illustrates a further embodiment of a sealing device according to the present disclosure. The same reference numbers designate the same or corresponding components as in FIG. 1. The embodiment of FIG. 2 differs from the embodiment of FIG. 1 as far as the angle of the helical projection(s) 17H is concerned. The inclination of the helical projection(s) in FIG. 2 is opposite the one of FIG. 1.

Figure 3:
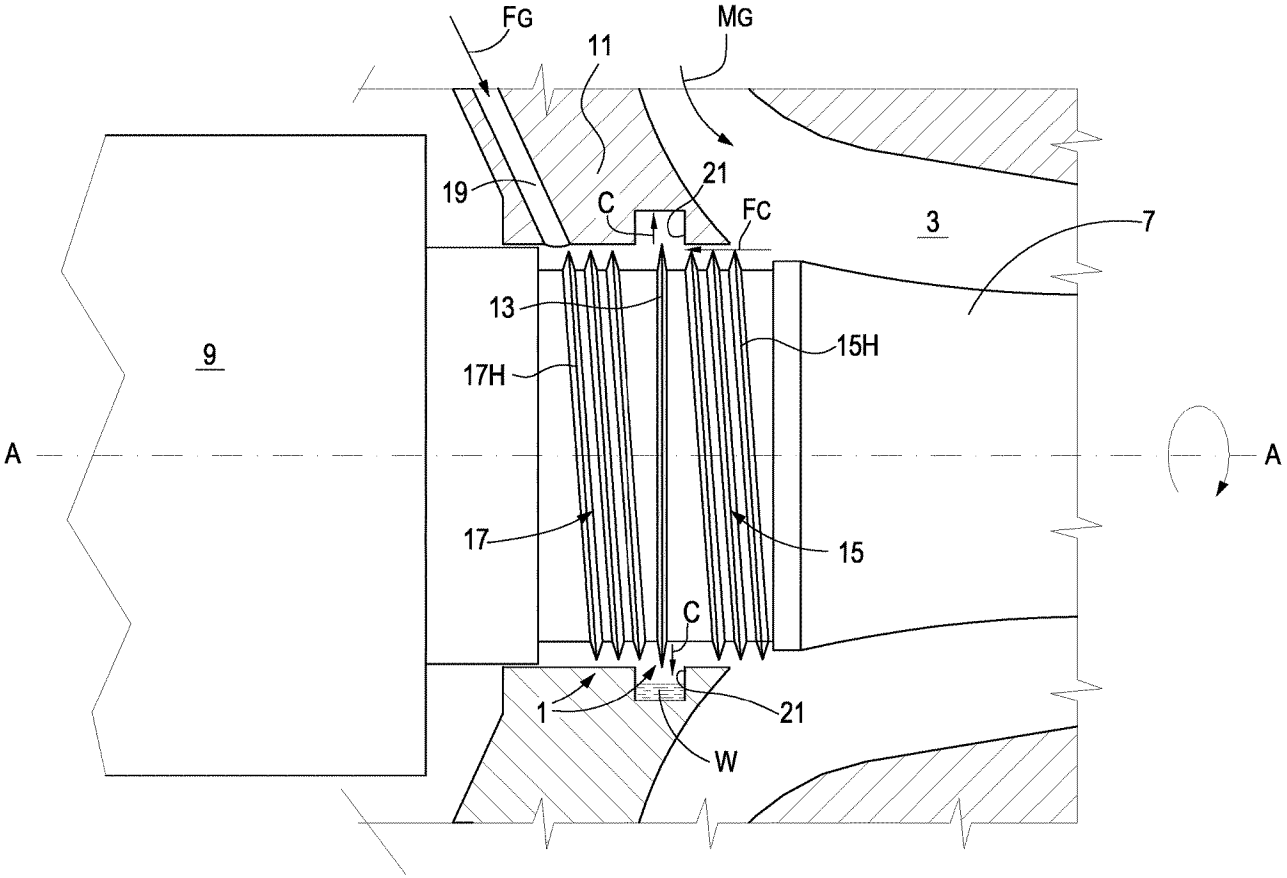

FIG. 3 illustrates a further embodiment of a sealing device according to the present disclosure. The same reference numbers designate the same or similar components as in FIGS. 1 and 2. The embodiment of FIG. 3 differs from the embodiment of FIG. 1 as far as the structure of the first sealing member 15 is concerned. In the embodiment of FIG. 3 the first sealing member 15 is similar in structure to the second sealing member 17, since both are comprised of one or more helical projections 15H, 17H, which form a single-threaded or multi-threaded screw arrangement.

In the embodiment of FIG. 3 the first sealing member 15 thus generates a pumping effect opposing the leakage of gas from the first compartment 3 towards the second compartment 5, additionally contributing to the sealing effect of the sealing device 1.

Figure 4:
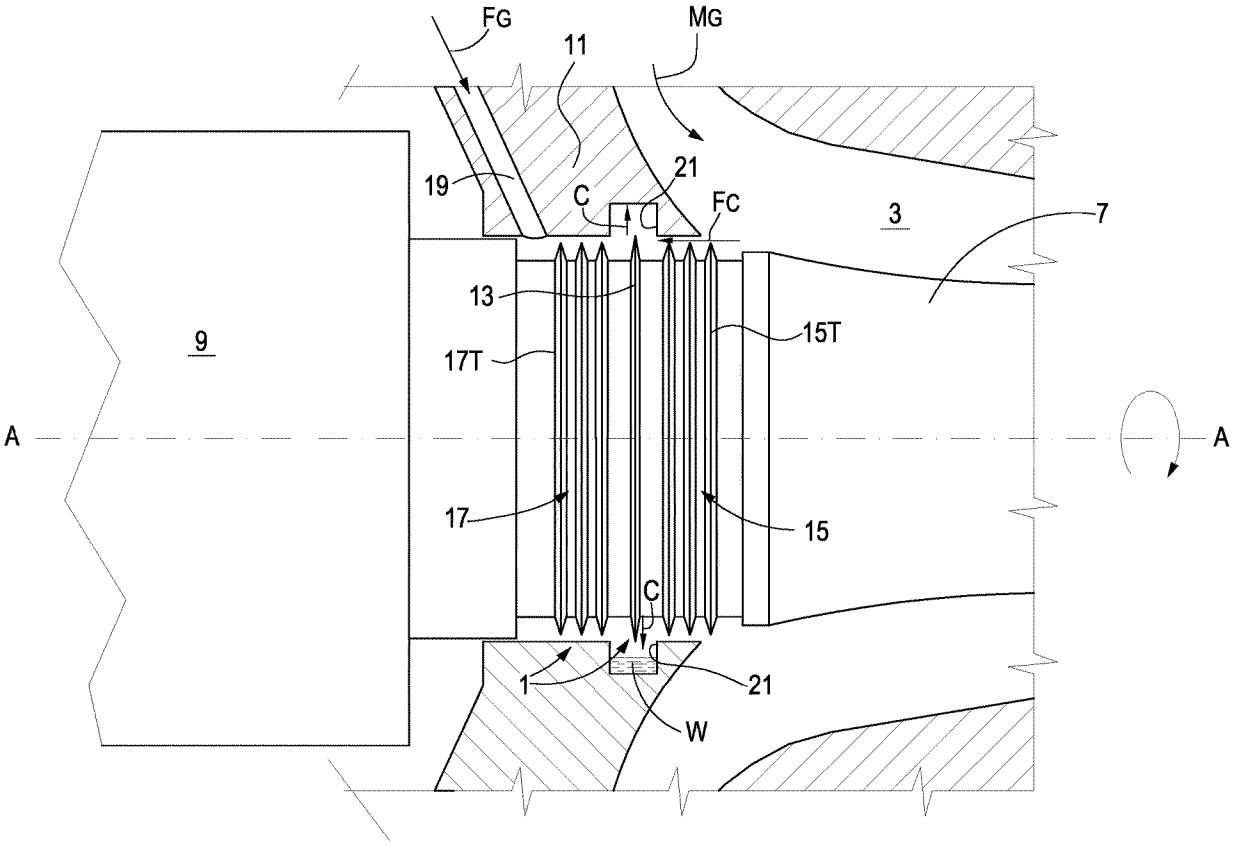

FIG. 4 schematically illustrates a further embodiment of a sealing device 1 according to the present disclosure. The same or similar components are labelled with the same reference numbers as in FIG. 1. In the embodiment of FIG. 4 the second sealing member 17 is comprised of annular sealing teeth 17T, in replacement for the helical projections 17H of FIG. 1, i.e. both sealing members 15 and 17 are comprised of annular or circular sealing teeth, rather than helical projections.

Figure 5:
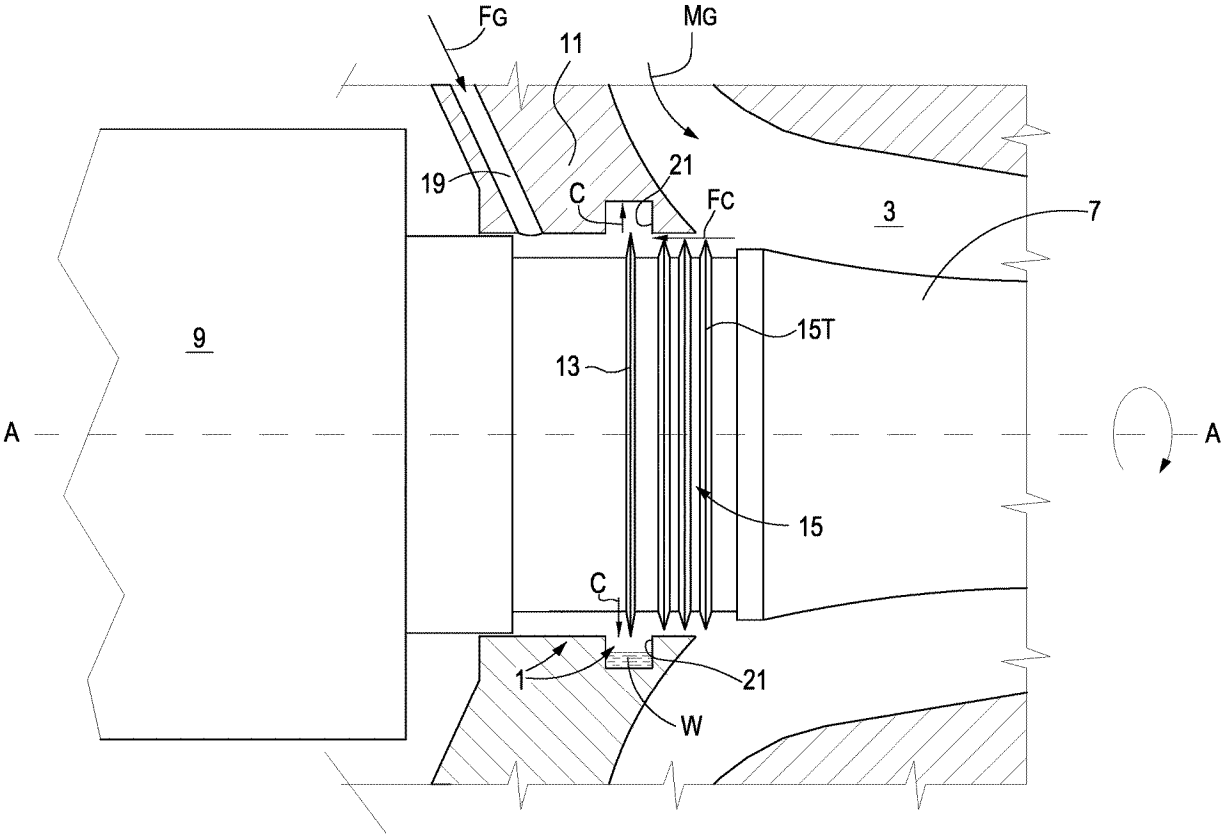

A further embodiment of a sealing device 1 according to the present disclosure is illustrated in FIG. 5. The same reference numbers designate the same or similar components as in FIG. 1. The embodiment of FIG. 5 differs from the embodiment of FIG. 1 in that the second sealing member 17 is omitted. The dry gas or buffer gas FG delivered through the dry gas delivery port(s) 19 flows directly toward the oil-jet ring 13. Sealing against penetration of gas from the first compartment 3 through the sealing device 1 and towards the second compartment 5 is ensured in this case by the first sealing member 15, in combination with the dry gas flow from the dry gas delivery port(s) 19.

Figure 6:
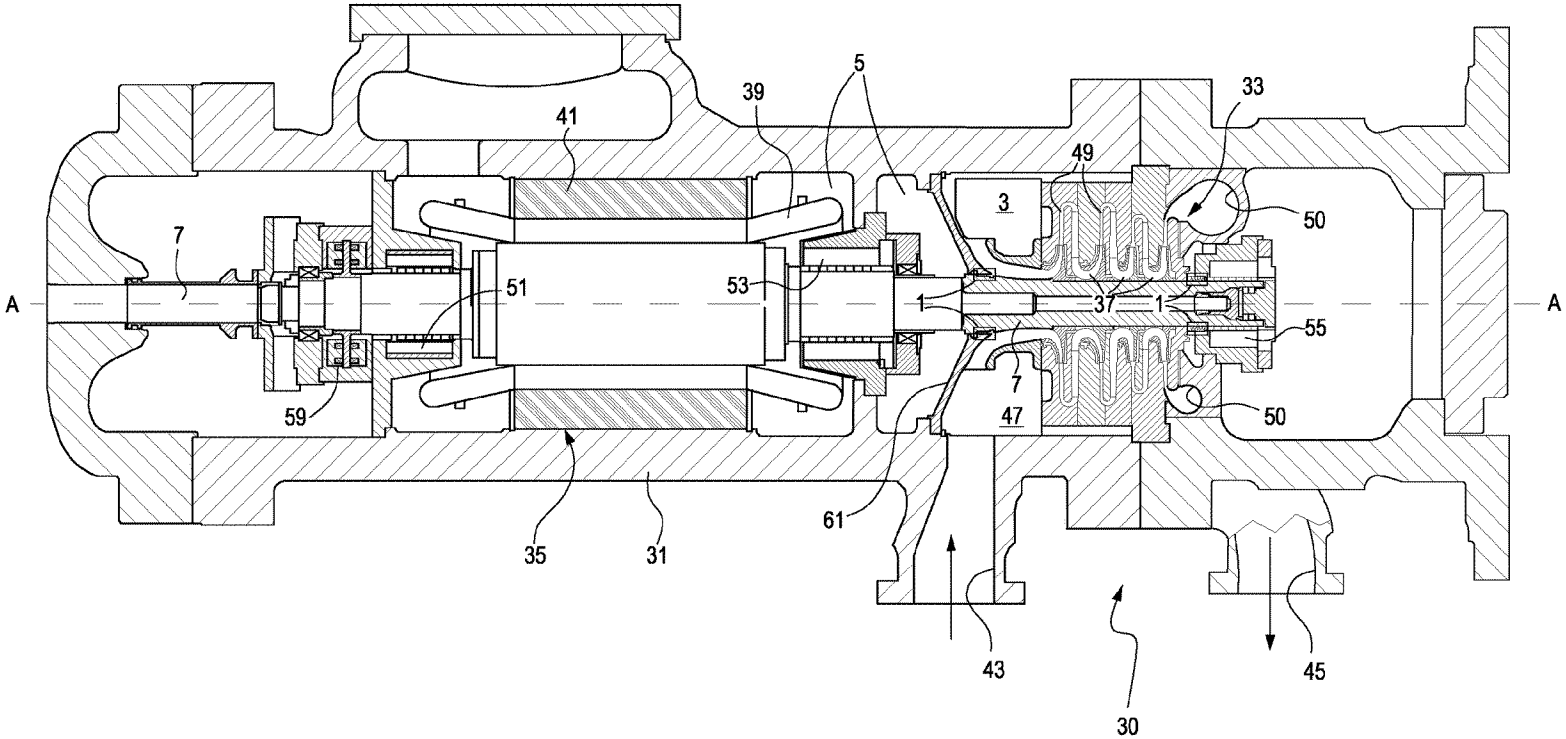
FIG. 6 is a sectional view of an integrated motor-compressor for subsea applications with sealing devices according to the present disclosure to protect contaminant-sensitive components of the turbomachine.

FIG. 6 schematically illustrates a sectional view according to a plane containing the rotation axis A-A of an integrated motor-compressor 30. In some embodiments the motor-compressor 30 can be a subsea motor-compressor, for example for extracting gas from a gas field and deliver the gas to an off-shore platform or vessel, where the gas is further processed, for instance liquefied for transportation on shore.

The motor-compressor 30 comprises a casing 31. The interior of casing 31 can be divided into a first compartment 3 and a second compartment 5. The first compartment 3 houses the very compressor, designated 33 as a whole. The second compartment 5 houses an electric motor 35. The compressor 33 can comprise one or several impellers 37, which are mounted on the rotating shaft 7 and integrally rotate therewith.

The shaft 7 extends through both compartments 3 and 5 and a rotor 39 of the electric motor 35 is mounted on shaft 7. The stator 41 of electric motor 35 is stationarily mounted in compartment 5. When the electric motor 35 is energized, it drives into rotation shaft 7 and impellers 37 of compressor 33. Gas is sucked into the compressor 33 through a gas inlet duct 43. Compressed gas is delivered at a higher pressure through gas outlet duct 45. More specifically, gas entering the gas inlet duct 43 enters an inlet plenum 47, wherefrom the gas is sucked into the first impeller of the first compressor stage and subsequently compressed through the various stages of the compressor 33.

In the exemplary embodiment of FIG. 6 the compressor 33 comprises four compressor stages and four respective impellers 47. Other embodiments provide for a different number of stages, for example one, two, three or more than four stages, each including a respective impeller.

Diffusers 49 are arranged around each impeller 37. Gas accelerated in each impeller 37 enters the relevant diffuser 49, wherein kinetic energy of the gas accelerated by the stage impeller is converted into pressure energy. From each diffuser 49 the gas is returned to the inlet of the subsequent impeller. The diffuser 49 of the last impeller is in fluid communication with a volute 50, which collects the compressed gas and conveys it toward the gas outlet duct 45.

The shaft 7 can be supported by a plurality of bearings. The bearings can be rolling bearings. In other embodiments, the bearings can be journal bearings. In further embodiments the bearings can be active magnetic bearings. A combination of different bearings can also be envisaged. The active magnetic bearings can be canned or un-canned active magnetic bearings.

In the embodiment illustrated in FIG. 6 the rotating shaft 7 is supported by three radial active magnetic bearings 51, 53 and 55. One radial active magnetic bearing is located near one end of the shaft 7 opposite the compressor 33. A further radial active magnetic bearing 53 is located between electric motor 35 and compressor 33. Another radial active magnetic bearing 55 is located on the end of shaft 7 opposite the electric motor 35.

An axial bearing 57 can also be provided, for providing an axial load capability. In the embodiment of FIG. 6 the axial bearing 57 is an active magnetic bearing. In some embodiments the axial bearing 57 can be located on the external side of the compressor 33, i.e. on the compressor side opposite the electric motor. In other embodiments the axial bearing 57 can be arranged between the compressor 33 and the electric motor 35.

In the embodiment of FIG. 6 the axial bearing 57 is mounted on the side of the electric motor 35 opposite the compressor 33.

The motor-compressor 30 can be provided with a cooling system for the electric motor 35 and with a cooling system for the active magnetic bearings, which are not described in detail herein. The cooling systems can comprise an open cooling loop or a closed or semi-closed cooling loop.

The compartment 3 is separated from the compartment 5 by a diaphragm 61 housing a sealing device 1, which provides a separation barrier between compartments 3 and 5. The sealing device 1 can be configured as disclosed herein above in connection with anyone of FIGS. 1 to 5.

The sealing device 1 thus separates the compartment 3, wherein the compressor 33 is housed, from the compartment 5 wherein the radial magnetic bearing 53, the electric motor 35 and the axial magnetic bearing 57 are housed. If wet gas or anyhow gas containing solid and/or liquid contaminants is processed by compressor 33, the sealing device 1 efficiently separates the compartment 3 from the compartment 5, preventing or limiting the ingress of contaminants in the compartment 5.

In some embodiments, further sealing devices 1 can be provided in the motor-compressor 33. For instance, a sealing device 1 can be located between the compressor 33 and the radial active magnetic bearing 55, to provide an effective separation between the contaminated gas processed by the compressor 33 and the contaminant-sensitive magnetic bearing 55.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A sealing device for separating a first compartment from a second compartment, the sealing device comprising:
- a rotary component;
- a stationary component;
- at least a first sealing member between the rotary component and the stationary component;
- an annular wet-particles collector;
- an oil-jet element, mounted on the rotary component for rotation therewith, the oil-jet element being surrounded by the annular wet-particles collector, such that wet articles contacting the oil-jet element are projected by centrifugal force into the annular wet-particles collector; and
- a dry-gas delivery port, arranged for delivering dry gas between the rotary component and the stationary component towards the first sealing member;
- wherein the first sealing member is arranged between the first compartment and the oil-j et element.

2. The device of claim 1, wherein the dry-gas delivery port is arranged between the oil-jet element and the second compartment.

3. The device of claim 1, wherein the oil-jet element is an oil-jet ring.

4. The device of claim 3, wherein the oil-jet ring has a peripherally sharp edge for facilitating the wet particles projection in the annular wet-particles collector.

5. The device of claim 1, wherein the first sealing member comprises a plurality of circumferential teeth forming a labyrinth seal adjacent the oil-jet element.

6. The device of claim 5, wherein the circumferential teeth are arranged on the rotary component for rotation therewith.

7. The device of claim 1, wherein the first sealing member comprises at least one helical projection arranged on the rotary component for rotation therewith.

8. The device of claim 1, further comprising a second sealing member between the rotary component and the stationary component, arranged between the oil-jet element and the second compartment.

9. The device of claim 8, wherein the second sealing member comprises a plurality of circumferential teeth forming a labyrinth seal adjacent the oil-jet element.

10. The device of claim 9, wherein the plurality of circumferential teeth of the second sealing member are arranged on the rotary component for rotation therewith.

11. The device of claim 8, wherein the second sealing member comprises at least one helical projection arranged on the rotary component for rotation therewith.

12. The device of claim 8, wherein the dry-gas delivery port is arranged between the second compartment and the second sealing member.

13. A wet-gas compressor comprising:
- a casing;
- at least one impeller arranged for rotation in a first compartment in the casing;
- at least a second compartment housing at least one contaminant-sensitive component; and
- a sealing device arranged between the first compartment and the second compartment, the sealing device comprising:
  - a rotary component;
  - a stationary component;
  - at least a first sealing member between the rotary component and the stationary component;
  - an annular wet-particles collector;
  - an oil-jet element, mounted on the rotary component for rotation therewith, the oil-jet element being surrounded by the annular wet-particles collector, such that wet articles contacting the oil-jet element are projected by centrifugal force into the annular wet-particles collector; and
  - a dry-gas delivery port, arranged for delivering dry gas between the rotary component and the stationary component towards the first sealing member;
- wherein the first sealing member is arranged between the first compartment and the oil-jet element.

14. A method for separating a first compartment from a second compartment, wherein a process gas containing contaminants is processed in the first compartment and a contaminant-sensitive component is housed in the second compartment; the method comprising:
- providing a stationary component and a rotary component between the first compartment and the second compartment;
- arranging at least a first sealing member between the first compartment and the second compartment;
- arranging an annular wet-particles collector between the first compartment and the second compartment, the annular wet-particles collector surrounding the rotary component;
- arranging an oil-jet element on the rotary component for rotation therewith, between the first sealing member and the second compartment, the oil-jet element being surrounded by the annular wet-particles collector;
- rotating the rotary component and the oil-jet element therewith;
- collecting contaminants with the oil-jet element and projecting by centrifugal force the contaminants with the oil-jet element into the annular wet-particles collector;
- arranging a dry-gas delivery port between the second compartment and the first sealing member; and delivering dry gas through the dry-gas delivery port towards the first sealing member.

15. The method of claim 14, further comprising the following step:

arranging a second sealing member between the oil-jet element and the second compartment, the dry-gas delivery port being arranged between the second compartment and the second sealing member.

16. The method of claim 14, wherein the first sealing member comprises at least one helical projection arranged on the rotary component for rotation therewith, the method further comprising the step of forwarding dry gas from the dry-gas delivery port towards the first compartment by rotating the helical projection.

17. The method of claim 15, wherein the second sealing member comprises at least one helical projection arranged on the rotary component for rotation therewith, the method further comprising the step of forwarding dry gas from the dry-gas delivery port towards the oil-jet element by rotating the helical projection.

18. The device of claim 1, wherein the device is in a turbomachine.

19. The compressor of claim 13, wherein the device is in a turbomachine.

20. The device of claim 14, wherein the method is in a turbomachine.

* * * * *